US011398375B2

(12) United States Patent
Baek et al.

(10) Patent No.: US 11,398,375 B2
(45) Date of Patent: Jul. 26, 2022

(54) MASS SPECTROMETRY SYSTEM AND METHOD

(71) Applicant: KOREA BASIC SCIENCE INSTITUTE, Daejeon (KR)

(72) Inventors: Ji Young Baek, Cheongju-si (KR); Myoung Choul Choi, Cheongju-si (KR); Chang Min Choi, Cheongju-si (KR); Sang Ju Lee, Gimhae-si (KR); Boo Ki Min, Ansan-si (KR)

(73) Assignee: KOREA BASIC SCIENCE INSTITUTE, Daejeon (KR)

( * ) Notice: Subject to any disclaimer, the term of this patent is extended or adjusted under 35 U.S.C. 154(b) by 0 days.

(21) Appl. No.: 16/937,862

(22) Filed: Jul. 24, 2020

(65) Prior Publication Data

US 2021/0090873 A1 Mar. 25, 2021

(30) Foreign Application Priority Data

Sep. 23, 2019 (KR) ..... 10-2019-0116946

(51) Int. Cl.
*H01J 49/16* (2006.01)
*H01J 49/00* (2006.01)
*H01J 49/40* (2006.01)

(52) U.S. Cl.
CPC ..... *H01J 49/164* (2013.01); *H01J 49/0031* (2013.01); *H01J 49/0036* (2013.01); *H01J 49/40* (2013.01)

(58) Field of Classification Search
CPC .. H01J 49/164; H01J 49/0031; H01J 49/0036; H01J 49/40
USPC ..... 250/288
See application file for complete search history.

(56) References Cited

U.S. PATENT DOCUMENTS 4,442,354 A * 4/1984 Hurst ..... H01J 49/142 427/523
4,874,946 A * 10/1989 Kazmerski ..... G01N 23/2258 850/10
4,945,236 A * 7/1990 Mogami ..... H01J 49/022 250/281
5,105,082 A * 4/1992 Maruo ..... H01J 49/4215 850/16
7,629,576 B2 * 12/2009 Schultz ..... H01J 49/0418 250/282

(Continued)

FOREIGN PATENT DOCUMENTS

JP 2007299658 A 11/2007
JP 2015081836 A 4/2015

*Primary Examiner* — Wyatt A Stoffa
(74) *Attorney, Agent, or Firm* — Warn Partners, P.C.

(57) ABSTRACT

A mass spectrometry system includes a sample holder provided in a vacuum changer and on which a sample is disposed, an irradiator configured to perform sputtering or ionization on the sample, an analyzer configured to analyze an ionized sample generated from the sample by the irradiator, and a controller configured to control the irradiator or the analyzer and perform a first process and a second process. The first process is to determine position information of materials in the sample by irradiating a laser or ion beam to a portion of the sample, and the second process is to irradiate a laser or ion beam of a first output value to another portion of the sample in a section in which the materials in the sample change and irradiate a laser or ion beam of a second output value in other sections.

5 Claims, 5 Drawing Sheets

(56) References Cited

U.S. PATENT DOCUMENTS

| | | | | |
|---|---|---|---|---|
| 2005/0035284 | A1* | 2/2005 | Schultz | H01J 49/164<br>250/281 |
| 2022/0115675 | A1* | 4/2022 | Steinbach | H01M 4/8871 |

* cited by examiner

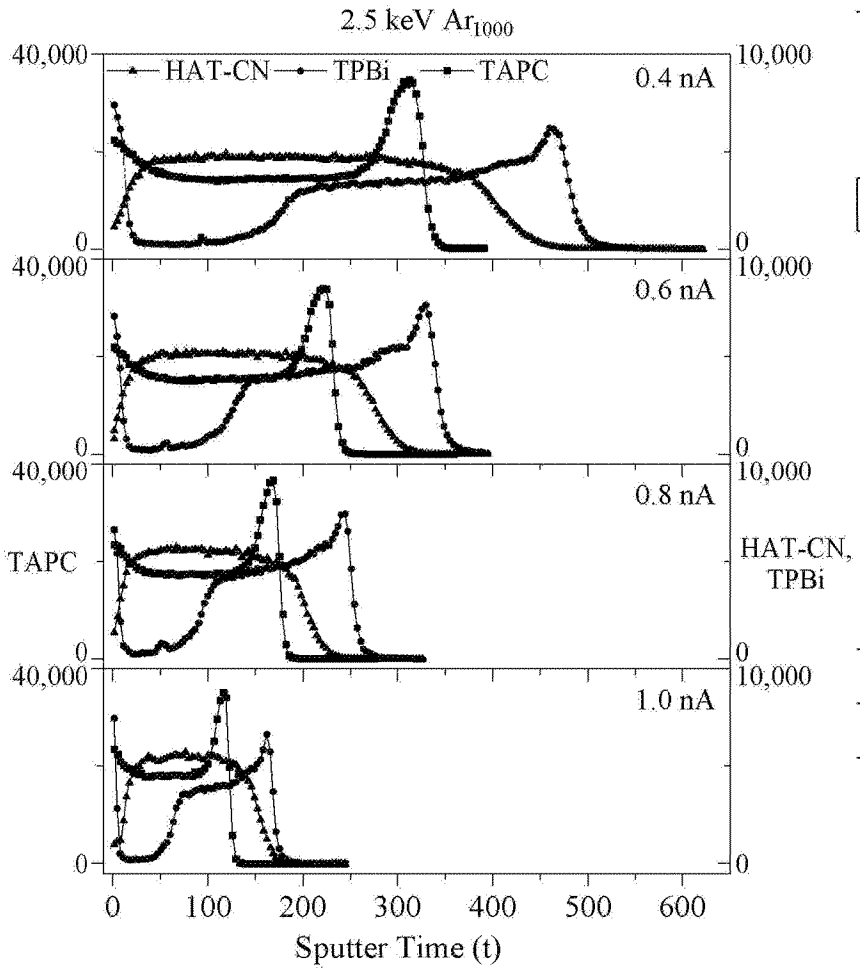

| Sputter Time (t) | | | |
|---|---|---|---|
| Beam Current | TAPC | HAT-CN | TPBi |
| 0.4 nA | 330 | 411 | 480 |
| 0.6 nA | 234 | 276 | 342 |
| 0.8 nA | 175 | 204 | 234 |
| 1.0 nA | 122 | 155 | 168 |

- Sputtering yield (S)

$$S = z\, r\, e\, NA / j_p\, t\, M$$

M = molar weight of the target (kg/mol)
r = density of the material (kg/m$^3$)
$N_A = 6.02*10^{26}$ 1/kmol (Avogadro number)
$e = 1.6*10^{-19}$ As (electron charge)
S = Sputtering yield (atom/ion)
$j_p$ = primary ion current density (A/m$^2$)
z = thickness
t = sputter time

| Sputtering yield (S) | | | |
|---|---|---|---|
| Beam Current | TAPC | HAT-CN | TPBi |
| 0.4 nA | $5.11*10^{-3}$ | $11.1*10^{-3}$ | $3.81*10^{-3}$ |
| 0.6 nA | $4.80*10^{-3}$ | $11.1*10^{-3}$ | $3.57*10^{-3}$ |
| 0.8 nA | $4.82*10^{-3}$ | $11.2*10^{-3}$ | $3.91*10^{-3}$ |
| 1.0 nA | $5.53*10^{-3}$ | $11.8*10^{-3}$ | $4.36*10^{-3}$ |

FIG.4

MASS SPECTROMETRY SYSTEM AND METHOD

CROSS-REFERENCE TO RELATED APPLICATION(S)

This application claims the benefit under 35 USC § 119(a) of Korean Patent Application No. 10-2019-0116946 filed on Sep. 23, 2019, in the Korean Intellectual Property Office, the entire disclosure of which is incorporated herein by reference for all purposes.

BACKGROUND

Field

One or more example embodiments relate to a mass spectrometry system and method.

Description of Related Art

A mass spectrometer separates an ionized molecule having a mass with different charge ratios and measures each ion current. The mass spectrometer may be classified into various types based on a method of separating ions.

In general, when a primary ion is irradiated onto a sample, a secondary-ion mass spectrometer (SIMS) analyzes composition of an element using a mass and charge of a secondary ion emitted by energy transfer from an atom of a surface of the sample. The SIMS may include, for example, a quadrupole SIMS (Q-SIMS), a magnetic sector SIMS (M-SIMS), a time-of-flight SIMS (ToF-SIMS), and the like according to a type of a mass spectrometry unit.

The Q-SIMS detects a desired ion by applying a direct current (DC) and a radio frequency (RF) to cylindrical four poles parallel with one another and separating ions based on intrinsic mass. The Q-SIMS may be reasonable in cost and effective in analyzing a component of an insulating material, although it has a low resolution.

The ToF-SIMS analyzes a component based on a TOF of an ion used for the ion to pass through an electrostatic energy analyzer provided in the SIMS and then arrive at a detector. The ToF-SIMS may have a wide range of intrinsic mass to be detected and a relatively high resolution. However, in the ToF-SIMS, the quantity of primary ions that is initially input is small, and thus a greater amount of time may be used for analyzing a component based on depth.

The M-SIMS analyzes a component based on a change in trajectory based on an intrinsic mass of a secondary ion by applying a magnetic field perpendicularly to a direction in which the secondary ion beam travels. The M-SIMS may have a relatively high resolution and a wide range of intrinsic mass to be measured. However, the M-SIMS may cost high, and may not be effective in analyzing a component of an insulating material because a high voltage is applied to a sample and thus charges are accumulated.

In a surface analysis based on such a general SIMS, when the analysis is performed only using an ion beam, a sample may be damaged severely, and an unnecessary signal may be generated in a low-mass area. Thus, accuracy in the analysis may be degraded.

For example, Korean Patent Publication No. 2009-004522 (published on May 8, 2009) discloses a mass spectrometry method of a SIMS.

The above description has been possessed or acquired by the inventor(s) in the course of conceiving the present disclosure and is not necessarily an art publicly known before the present application is filed.

SUMMARY

An aspect provides a mass spectrometry system and method that may minimize the generation of an unnecessary signal in a low-mass area by sputtering a sample using an ion beam and ionizing the sample using a laser, and then analyzing a result therefrom.

An aspect provides a mass spectrometry system and method that may minimize the damage to a sample by sputtering the sample using an ion beam and ionizing the sample using a laser, and then analyzing a result therefrom.

An aspect provides a mass spectrometry system and method that may analyze a sample rapidly and effectively by performing a first process that determines position information of materials included in the sample before performing a second process that analyzes the sample.

According to an example embodiment, there is provided a mass spectrometry system including a sample holder provided in a vacuum chamber and on which a sample is disposed, an irradiator configured to perform sputtering or ionization on the sample disposed on the sample holder, an analyzer configured to analyze an ionized sample generated from the sample by the irradiator, and a controller configured to control the irradiator or the analyzer. The controller may perform a first process and a second process. The first process may include irradiating a laser or ion beam to a portion of the sample and determining position information of one or more materials included in the sample. The second process may include irradiating, to another portion of the sample, a laser or ion beam of a first output value in a section in which the materials included in the sample change, and irradiating a laser or ion beam of a second output value in other sections.

The irradiator may include a first irradiation source including an ion beam source, and a second irradiation source including a laser beam source.

The first process may be performed on an edge portion of the sample which is a target to be analyzed, and performed by the first irradiation source. The second process may include the sputtering of the sample and the ionization of the sample, and the sputtering may be performed by the first irradiation source and the ionization may be performed by the second irradiation source. The sputtering and the ionization may be performed alternately.

The sputtering may be performed by the ion beam of the first output value in the section in which the materials included in the sample change, and the sputtering may be performed by the ion beam of the second output value in the other sections.

The ionization may be performed by a laser of a third output value in an entire section.

The first output value may be less than the second output value.

The first process may be repeatedly performed a plural number of times, and the position information of the materials included in the sample is calculated based on a mean value of sets of data of the first process performed each time.

The section in which the materials included in the sample change is defined as a range with an error of 5% to 10% in a vertical direction based on a reformed surface formed by different materials.

The first output value may be different from the second output value, and the first output value or the second output value may be set based on a prestored data table.

The irradiator may include a single ion beam source. The first process may be performed by the ion beam. In the second process, the sputtering and the ionization may be performed by the ion beam of the first output value in the section in which the materials included in the sample change, and the sputtering and the ionization may be performed by the ion beam of the second output value in the other sections.

According to another example embodiment, there is provided a mass spectrometry method including determining position information of one or more materials included in a sample by irradiating an ion beam to a portion of the sample, and analyzing the sample by irradiating an ion beam for sputtering to another portion of the sample and irradiating a laser for ionization of the sample to the other portion of the sample, based on the position information. The sputtering and the ionization may be performed alternately in sequential order.

The analyzing may include performing the sputtering by an ion beam of a first output value in a section in which the materials included in the sample change, performing the sputtering by an ion beam of a second output value in other sections, and performing the ionization on the sample by a laser of a third output value in an entire section. The first output value may be less than the second output value.

The determining of the position information may be repeatedly performed a plural number of times. The position information of the materials included in the sample may be calculated based on a mean value of sets of data obtained by the determining of the position information performed each time. The section in which the materials included in the sample change may be defined as a range with an error of 5% to 10% in a vertical direction based on a reformed surface formed by different materials.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the present disclosure will become apparent and more readily appreciated from the following description of example embodiments, taken in conjunction with the accompanying drawings of which:

FIG. 4 is an example of experimental data of an ion beam and a laser included in a mass spectrometry system according to an example embodiment.

DETAILED DESCRIPTION

Figure 1:
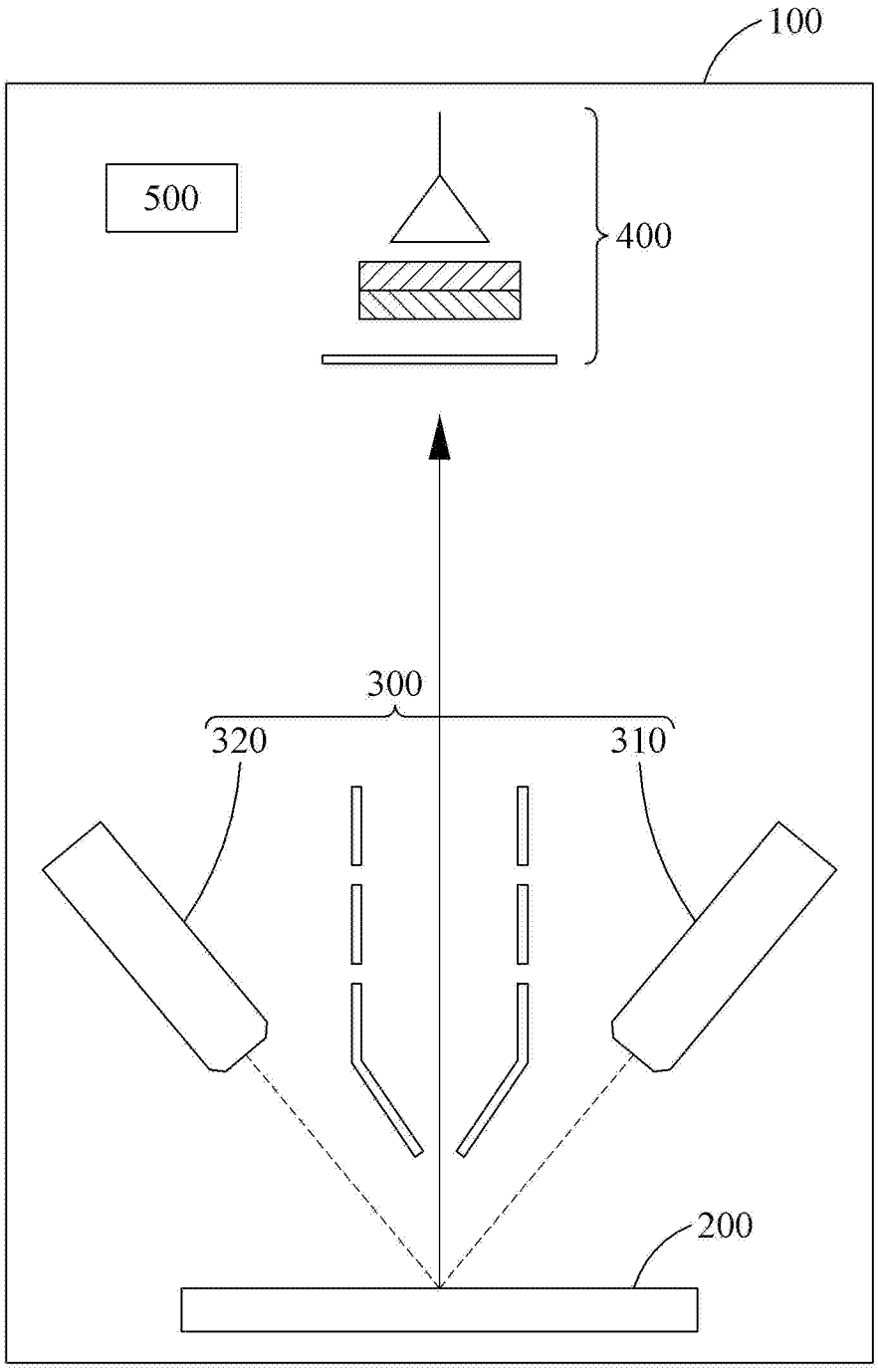
FIG. 1 is a diagram illustrating a mass spectrometry system according to an example embodiment.

Hereinafter, example embodiments will be described in detail with reference to the accompanying drawings. It should be understood, however, that there is no intent to limit this disclosure to the particular example embodiments disclosed. On the contrary, example embodiments are to cover all modifications, equivalents, and alternatives falling within the scope of the example embodiments.

The terminology used herein is for the purpose of describing particular example embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. In addition, terms such as first, second, A, B, (a), (b), and the like may be used herein to describe components. Each of these terminologies is not used to define an essence, order, or sequence of a corresponding component but used merely to distinguish the corresponding component from other component(s). It should be noted that if it is described in the specification that one component is "connected," "coupled," or "joined" to another component, a third component may be "connected," "coupled," and "joined" between the first and second components, although the first component may be directly connected, coupled or joined to the second component.

Hereinafter, example embodiments will be described in detail with reference to the accompanying drawings. In the description of example embodiments, detailed description of well-known related structures or functions will be omitted when it is deemed that such description will cause ambiguous interpretation of the present disclosure. Regarding the reference numerals assigned to the elements in the drawings, it should be noted that the same elements will be designated by the same reference numerals, wherever possible, even though they are shown in different drawings.

Figure 2:
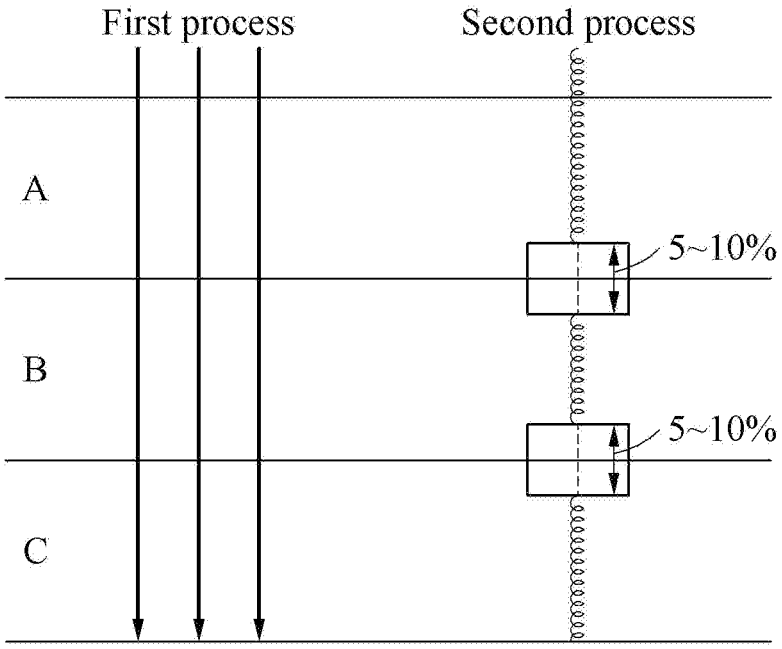
FIG. 2 is a diagram illustrating a first process and a second process of a mass spectrometry system according to an example embodiment.
Figure 3:
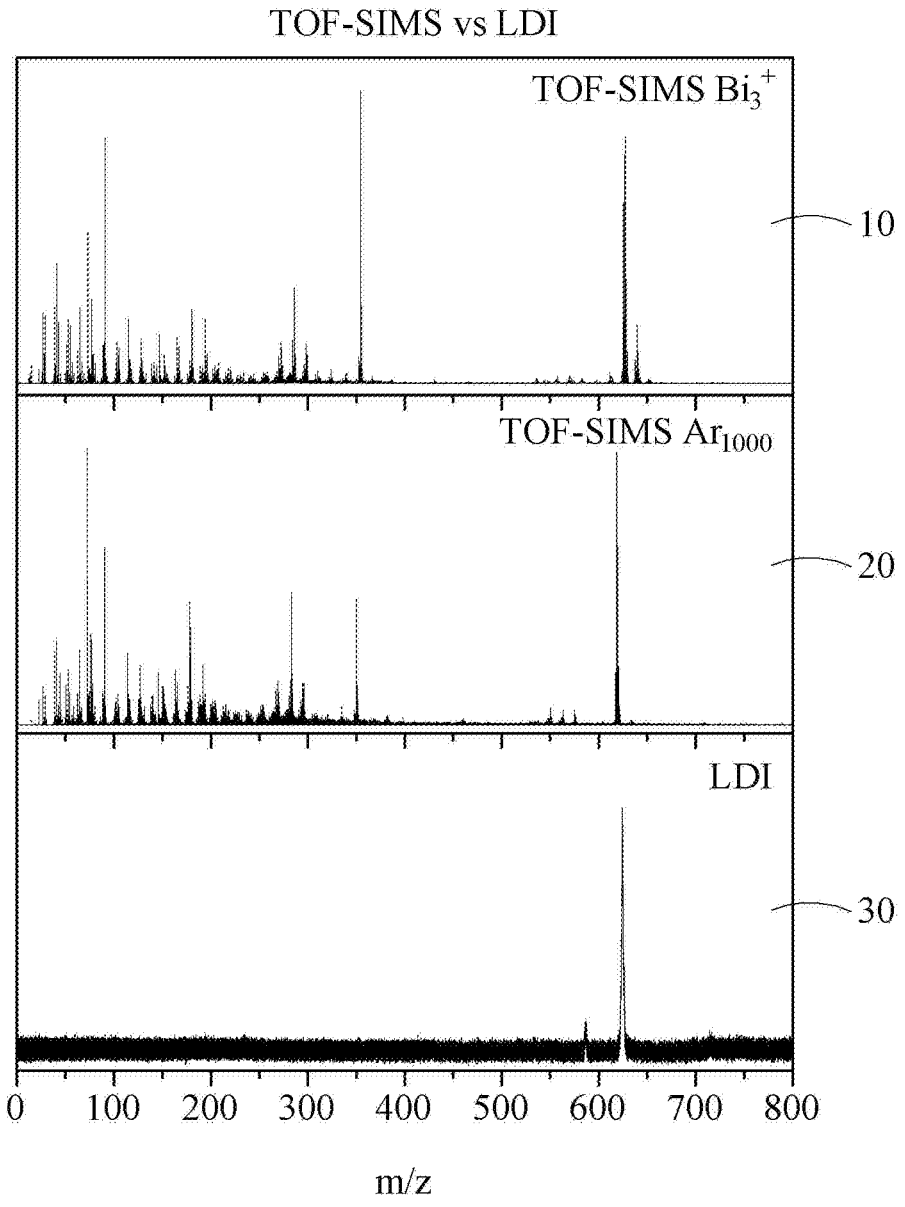
FIG. 3 is an example of experimental data of an ion beam and a laser included in a mass spectrometry system according to an example embodiment.
Figure 5:
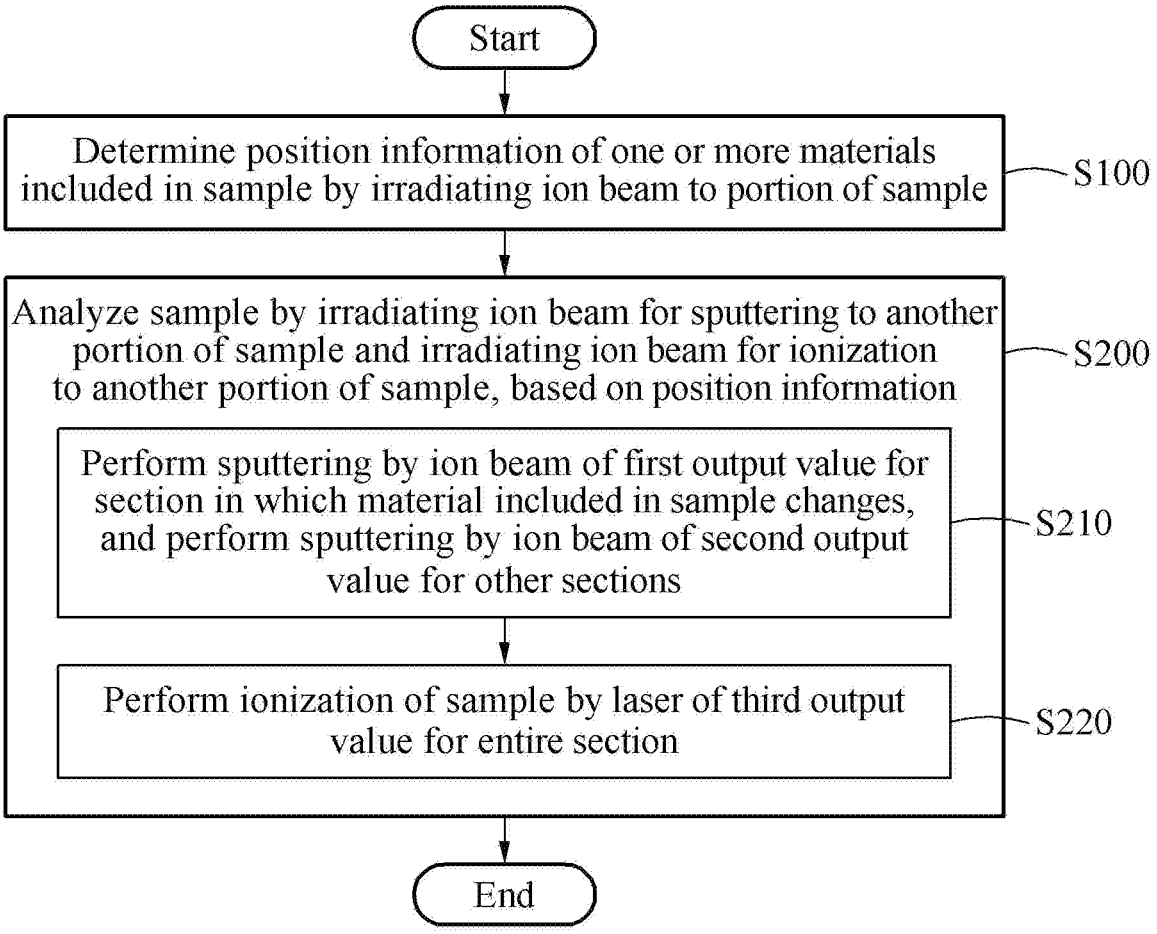
FIG. 5 is a flowchart illustrating a mass spectrometry method according to an example embodiment.

FIG. 1 is a diagram illustrating a mass spectrometry system according to an example embodiment. FIG. 2 is a diagram illustrating a first process and a second process of a mass spectrometry system according to an example embodiment. FIGS. 3 and 4 are examples of experimental data of an ion beam and a laser included in a mass spectrometry system according to an example embodiment. FIG. 5 is a flowchart illustrating a mass spectrometry method according to an example embodiment.

Referring to FIG. 1, a mass spectrometry system includes a sample holder 200 provided in a vacuum chamber 100 and on which a sample is to be disposed, an irradiator 300 configured to perform sputtering or ionization on the sample disposed on the sample holder 200, an analyzer 400 configured to analyze an ionized sample generated from the sample by the irradiator 300, and a controller 500 configured to control the irradiator 300 or the analyzer 400.

The irradiator 300 includes a first irradiation source 310 including an ion beam source and a second irradiation source 320 including a laser beam source. The ion beam source may be a gas cluster ion beam (GCIB) source, for example.

The controller 500 performs a first process and a second process.

In detail, referring to FIG. 2, the first process is to determine position information of one or more materials included in the sample by irradiating a laser beam or an ion beam to a portion of the sample. The second process is to irradiate a laser beam or an ion beam of a first output value to another portion of the sample in a section in which the materials included in the sample change, and irradiate a laser beam or an ion beam of a second output value in other sections, based on the determined position information.

That is, before the second process that performs a practical analysis of the sample including unknown materials, the first process may be performed first to determine the position information of the materials included in the sample, for example, information about a height position at which a material is positioned.

Thus, by determining a position of a reformed surface formed by different materials included in the sample before performing the second process, it is possible to increase an analysis speed by performing the analysis using a laser beam or an ion beam with a high output value in previous sections prior to the reformed surface under the assumption that a same material exists continuously in the previous sections prior to the reformed surface, and to increase accuracy by performing the analysis using a laser beam or an ion beam with a low output value in a section corresponding to the reformed surface for a more precise analysis. Thus, it is possible to improve both the efficiency and the accuracy in the entire analysis. Here, the first process may be a preliminary and preceding process that is performed on an edge portion of the sample which is a target to be analyzed.

Hereinafter, a detailed mechanism of the first process and the second process will be described in detail. Both the first process and the second process may include sputtering that sputters a surface of the sample and simply strips the sample layer by layer, and ionization that ionizes the sample to analyze materials included in the sample. The sputtering and the ionization may be performed alternately in sequential order.

For example, the sputtering and the ionization in the first process may be performed all by a first irradiation source. The sputtering of the sample in the second process may be performed by the first irradiation source, and the ionization of the sample in the second process may be performed by a second irradiation source.

In this example, the sputtering and the ionization in the first process may be performed by an ion beam of a single output value.

In contrast, the sputtering in the second process may be performed by an ion beam of a first output value, for a section in which the materials included in the sample change. In addition, the sputtering in the second process may be performed by an ion beam of a second output value, for other sections excluding the section. Here, the first output value may be less than the second output value.

In addition, the ionization of the sample in the second process may be performed by a laser beam of a third output value, for an entire section.

The first process may be repeatedly performed a plural number of times. Thus, the position information of the one or more materials included in the sample may be calculated through a mean value of sets of data obtained through the first process performed each time.

Here, the section in which the materials included in the sample change may be defined as a range having an error of 5% to 10% in a vertical direction based on the reformed surface formed by different materials included in the sample.

The first output value and the second output value may be different from each other. The first output value or the second output value may be set based on a prestored data table. That is, the first output value or the second output value may be set to be an optimal output value by referring to the data table prestored based on types of the materials forming the sample that are determined through the first process.

According to another example, an irradiator may include a single ion beam source. In this example, both the first process and the second process may be performed by an ion beam. However, in the second process, the sputtering and the ionization may be performed by an ion beam of a first output value for the section in which the materials included in the sample change, and be performed by an ion beam of a second output value for the other sections excluding the section.

Referring to FIG. 3, when an analysis is performed by an ion beam using bismuth or argon, an unnecessary signal may be generated in a low-mass area as illustrated in 10 and 20 of FIG. 3. However, when the analysis is performed using a laser, for example, laser desorption ionization (LDI), it is possible to prevent the generation of an unnecessary signal in the low-mass area as illustrated in 30 of FIG. 3.

FIG. 4 illustrates a time used when performing sputtering using an argon GCIB (Ar GCIB). For example, as illustrated, the sputtering was performed on TAPC, HAT-CN, and TPBi using an Ar GCIB with 2.5 kiloelectron-volts (keV) and an Ar cluster size of 1000, and a time used for performing the sputtering to a certain depth was measured.

In detail, respective sputter times for the three materials were measured by adjusting a beam current of the Ar GCIB with 2.5 keV and the 1000 Ar cluster size to 0.4, 0.6, 0.8, and 1.0 nA. Here, a time used to sputter the sample to a depth of 50 nanometers (nm) was measured. Referring to experimental data of FIG. 4, when performing the sputtering with the beam current of 0.4 nA, it was verified that there is a great difference in sputter time among the three materials. In contrast, when the beam current is set to be 1.0 nA, it was verified that a deviation in sputter time among the three materials is the smallest.

Thus, for example, when sputtering an organic light-emitting diode (OLED) sample to a depth of 50 nm by setting a beam current of an Ar GCIB with 2.5 keV and a 1000 Ar cluster size to be 1.0 nA, it was verified that the sputtering is completed in approximately 150 seconds for the three materials.

Referring to FIG. 5, a mass spectrometry method includes step S100 of determining position information of one or more materials included in a sample by irradiating an ion beam to a portion of the sample, and step S200 of analyzing the sample by irradiating an ion beam for sputtering to another portion of the sample and irradiating a laser for ionization of the sample to the other portion of the sample, based on the determined position information. The sputtering and the ionization may be performed alternately in sequential order.

Step S200 of analyzing the sample includes step S210 of performing the sputtering by an ion beam of a first output value for a section in which the materials included in the sample change and performing the sputtering by an ion beam of a second output value for other sections excluding the section, and step S220 of performing the ionization of the sample by a laser of a third output value for an entire section. The first output value may be less than the second output value.

Step S100 of determining the position information may be repeatedly performed a plural number of times, and the position information of the materials included in the sample may be calculated through a mean value of sets of data obtained by determining the position information performed each time.

The section in which the materials included in the sample change may be defined as a range having an error of 5% to 10% in a vertical direction based on a reformed surface formed by different materials included in the sample.

As described above, a mass spectrometry system and method described herein may analyze a sample by sputtering the sample using an ion beam and then ionizing the sample using a laser, and thus minimize the generation of an unnecessary signal in a low-mass area and minimize the damage to the sample.

In addition, the mass spectrometry system and method may first perform a first process that determines position information of materials included in the sample before performing a second process that analyzes the sample, and thus analyze the sample more precisely and effectively and also increase a resolution in mass, depth profile, and imaging analyses of a sample formed of a bio or organic material.

According to example embodiments described herein, a mass spectrometry system and method may minimize the generation of an unnecessary signal in a low-mass area by sputtering a sample using an ion beam and ionizing the sample using a laser, and then analyzing a result therefrom.

According to example embodiments described herein, a mass spectrometry system and method may minimize the damage to a sample by sputtering the sample using an ion beam and ionizing the sample using a laser, and then analyzing a result therefrom.

According to example embodiments described herein, a mass spectrometry system and method may analyze a sample rapidly and effectively by performing a first process that determines position information of materials included in the sample before performing a second process that analyzes the sample.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents.

Therefore, the scope of the disclosure is defined not by the detailed description, but by the claims and their equivalents, and all variations within the scope of the claims and their equivalents are to be construed as being included in the disclosure.

What is claimed is:

1. A mass spectrometry system comprising:

a sample holder provided in a vacuum chamber and on which a sample is disposed;

an irradiator configured to perform sputtering or ionization on the sample disposed on the sample holder;

an analyzer configured to analyze an ionized sample generated from the sample by the irradiator; and a controller configured to control the irradiator or the analyzer, wherein the controller is configured to perform a first process and a second process, wherein the first process comprises irradiating an ion beam to a portion of the sample and determining position information of one or more materials included in the sample, and the second process comprises irradiating, to another portion of the sample, a ion beam of a first output value in a section in which the materials included in the sample change, and irradiating a laser beam of a third output value in other sections;

wherein the first process is performed on an edge portion of the sample which is a target to be analyzed, and performed by the first irradiation source, and the second process comprises the sputtering of the sample and the ionization of the sample, and the sputtering is performed by the first irradiation source and the ionization is performed by the second irradiation source, wherein the sputtering and the ionization are performed alternately, wherein the sputtering is performed by the ion beam of the first output value in the section in which the materials included in the sample change, and the sputtering is performed by the ion beam of the second output value in the other sections, and the ionization is performed by the laser of a third output value in an entire section; and wherein the first output value is less than the second output value, and wherein the first process is repeatedly performed a plural number of times, and the position information of the materials included in the sample is calculated based on a mean value of sets of data of the first process performed each time, and wherein the section in which the materials included in the sample change is defined as a range with an error of 5% to 10% in a vertical direction based on a reformed surface formed by different materials.

2. The mass spectrometry system of claim 1, wherein the first output value or the second output value is set based on a prestored data table.

3. The mass spectrometry system of claim 1 wherein the sample is formed or bio or organic material.

4. A mass spectrometry method comprising:

determining position information of one or more materials included in a sample by irradiating an ion beam to a portion of the sample; and analyzing the sample by irradiating an ion beam for sputtering to another portion of the sample and irradiating a laser for ionization of the sample to the other portion of the sample, based on the position information, wherein the sputtering and the ionization are performed alternately in sequential order, wherein the analyzing comprises:

performing the sputtering by an ion beam of a first output value in a section in which the materials included in the sample change, and performing the sputtering by an ion beam of a second output value in other sections, wherein the first output value is less than the second output value;

performing the ionization on the sample by a laser of a third output value in an entire section;

wherein the determining of the position information is repeatedly performed a plural number of times, wherein the position information of the materials included in the sample is calculated based on a mean value of sets of data obtained by the determining of the position information performed each time, and the section in which the materials included in the sample change is defined as a range with an error of 5% to 10% in a vertical direction based on a reformed surface formed by different materials.

5. The mass spectrometry method of claim 4 wherein the sample is formed of bio or organic material.

* * * * *